US005826363A

United States Patent [19]

Olson

[11] Patent Number: 5,826,363

[45] Date of Patent: Oct. 27, 1998

[54] RAIL ADAPTER HANDGUARD SYSTEMS FOR FIREARMS

[75] Inventor: Douglas D. Olson, Vero Beach, Fla.

[73] Assignee: Knights Armament Company, Vero Beach, Fla.

[21] Appl. No.: 891,141

[22] Filed: Jul. 10, 1997

[51] Int. Cl.[6] ..... F41A 21/00

[52] U.S. Cl. ..... 42/75.01; 42/75.03

[58] Field of Search ..... 42/75.01, 75.02, 42/103, 72, 71.01, 101, 102; 89/14.1, 37.01

[56] References Cited

U.S. PATENT DOCUMENTS

| | | | |
|---|---|---|---|
| 2,128,936 | 9/1938 | Green | 89/14.1 |
| 2,287,066 | 6/1942 | Rogers | 257/263 |
| 2,965,994 | 12/1960 | Sullivan | 42/71 |
| 3,075,314 | 1/1963 | Bakker | 42/71 |
| 3,090,150 | 5/1963 | Stoner | 42/71 |
| 3,857,323 | 12/1974 | Rvaer et al. | 89/191 R |
| 4,536,982 | 8/1985 | Bredbury et al. | 42/71 R |
| 4,663,875 | 5/1987 | Tatro | 42/71.01 |
| 4,733,489 | 3/1988 | Kurak | 42/77 |
| 5,010,676 | 4/1991 | Kennedy | 42/71.01 |
| 5,092,071 | 3/1992 | Moore | 42/85 |
| 5,111,587 | 5/1992 | Plank | 33/247 |
| 5,198,600 | 3/1993 | E'Nama | 42/90 |
| 5,201,135 | 4/1993 | Cowles | 42/101 |
| 5,590,484 | 1/1997 | Mooney et al. | 42/100 |
| 5,634,288 | 6/1997 | Martel | 42/71.01 |

*Primary Examiner*—Charles Jordan
*Assistant Examiner*—Meena Chelliah
*Attorney, Agent, or Firm*—Carroll F. Palmer

[57] ABSTRACT

Improved rail adapter systems which enable firearms, including M16 type rifles and carbines, without any changes to the weapon except the handguard, to support accessory devices effectively even under combat conditions are provided via the invention by modification of the top semicylinderical part of the rifle's handguard attachment to include an elongated leaf spring arrangement in the front end and a unique rear clamp arrangement at the back end thereof so the leaf spring and rear clamp combination operate to compensate for thermal dimensional changes and combat abuse problems to maintain proper alignment of accessory devices attached to the weapon.

10 Claims, 5 Drawing Sheets

28
42
24
43
42S
32

32
43
24
42
42S
7
7

24
74
86

24
32
11
24
28
24
11

24

24

44
24
86

RAIL ADAPTER HANDGUARD SYSTEMS FOR FIREARMS

BACKGROUND OF THE INVENTION

1. Field of the Invention

This application relates to handguard systems for the barrels of rifles, carbines, shotguns, machine guns and like firearms. More particularly, it concerns such handguard systems of an improved type having rail adapters to accept and effectively support accessory devices, e.g., infrared and night vision scopes, laser spotters and the like.

2. Description of the Prior Art

It is well known to those skilled in the art that rapid fire firearms utilized particularly in military operations, e.g., M16 type rifles, are characterized by the heating of the barrels to relatively high temperatures. At such temperatures, the barrels cannot be safely held by the person firing them. Consequently, a variety of handguards have been developed for such rapid fire guns to provide adequate cooling for the gun barrel and mitigate the possibility of burning the hand of the person firing the gun as disclosed in U.S. Pat. Nos.2,965,994, 3,075,314, 3,090,150, 4,536,982, 4,663,875 & 5,010,676.

With the continuing application of newly developed technologies, e.g., lasers, infrared ray scopes, microcomputerization, etc., to modern warfare, the basic combat weapon, i.e., rifles, carbines and shotguns, have become relatively complicated pieces of hardware. This has resulted in requirements for the association of these weapons with a variety of accessories such as infrared and night vision scopes, laser spotters and the like. Meeting this requirement has resulted in development of various types of multi-purpose rifle mounting devices, e.g., see U.S. Pat. Nos.4,026,054, 4,733,489, 4,845,871, 5,198,600, 5,343,650 & 5,590,484.

Because of the tremendous abuse to which firearms are continually subjected, particularly in combat, plus the need for as much simplicity as possible in construction and use of the weapon, very serious requirements and restrictions are encountered in the development of militarily acceptable systems for mounting accessories to firearms. The present invention has fulfilled these requirements while providing the art with improved handguard systems that incorporate rail adapters to accept and support accessory devices.

OBJECTS

A principal object of the invention is the provision of improved firearms handguard systems that comprise rail adapters to accept and support accessory devices.

A further object is the provision of such improved rail adapter systems (RAS) that require no permanent modification of the weapon with which they are used.

Another object is the provision of a RAS for M-16 type rifles that acceptably stabilize the RAS to the weapon.

An additional object is the provision of a RAS that is prevented from locking too securely to the weapon barrel.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of new rail adapter systems that enable the mounting of additional accessory interface surfaces to a firearm in a way that keeps those surfaces in line with the barrel of the firearm yet with sufficient longitudinal travel to account for the varying expansion rates of dissimilar metals.

The prior art involved attaching these accessory interface surfaces to the AR-15 series of rifles in place of the original handguards. The prior art replacement handguard pieces include an upper portion with three accessory surfaces located at the nine o'clock, twelve o'clock and three o'clock positions. The lower replacement handguard has an accessory surface at the six o'clock position. The rears of the replacement handguards were originally held captive by the rifles spring loaded rear slip ring while the front of the upper replacement handguard was clamped upward to the front handguard clip. This arrangement proved to allow undesirable movement of the handguard when the rear slip ring was moved unintentionally or when the front handguard clip was loose on the weapon.

The unique attachment of the handguard in accordance with the invention creates an interface with the firearm that is not only more secure from unintentional movement, but is more accurately aligned with the barrel. The new system of the invention incorporates a clamp at the rear of the handguard that secures the handguard against the barrel retaining nut. This clamp straddles the gas tube and pulls up against an inner recess in the barrel nut. The clamping force is applied through the handguard and into its dowel pins that interface with two of the scallops on the barrel nut. The line of force provides a small moment that tends to force the front of the handguard downward toward the barrel.

The clamp is pivoted about a roll pin through the handguard to allow for a rotation of the clamp out of the barrel nut recess during removal and installation. The clamp works irrespective of the force applied by the rifles rear handguard clamp and thus the position of the upper handguard is maintained even when the rear slip ring is moved (as in removing the lower handguard to install a M203 Grenade Launcher). A screw provides the means for applying the force to the clamp relative to the handguard.

Since the original weapon design had no provision for supporting the front of the handguard against the barrel directly, the invention provides a new supporting interface. Such support straddles the gas tube leading from the front sight post and has two resting pads on the barrel sufficiently separated to provide a three-point support for the handguard. This support has sufficient flexibility so that a downward force from the handguard results in the two side pieces moving to firmly contact the sides of the gas tube. This pinching effect tends to remove all front rotational play from the handguard as well as preventing exterior loading from torquing the handguard.

A leaf spring provides an additional downward force on the front of the handguard by lifting up on the inside top of the rifle's front handguard clip. The leaf spring contacts the support piece behind its pivotal anchor to the handguard and thus tends to force the support piece toward the handguard. Keeping the loading directions correct is fundamental to holding the handguard tight against the barrel. This force is sufficient to hold the front of the handguard down upon the barrel, but not so much that the greater expansion of the aluminum handguard as compared to the barrel doesn't cause the alignment of the two to shift relative to each other.

The actual firing of the weapon causes the handguard to find its natural 'home' on the weapon. Excessive external forces can cause the handguard to shift out of this 'home' position, but firing one or two shots will automatically return it to 'home'. Since there will always be some shock that would move the handguard out of position no matter how well secured it is, it has been discovered to be better that spring pressure and the firing of one or two rounds reset the handguard to its 'home' position rather than having excessive clamping pressure which can hold the handguard in an out of position location.

Thermal expansion of the aluminum handguard and the steel barrel produce movements relative to each other when the weapon is subjected to varying thermal extremes. In accordance with the invention, all of this movement is along the long axis of the barrel and thus when the handguard slips relative to the barrel, the points of aim of both the rifle and the handguard remain unchanged. In the case of a screw clamped front latch, the barrel and handguard do not slip relative to each other which causes point of aim shifts relative to each other. The latch is strong enough that it can hold the two parts in different locations when fired in prolonged situations. The force that the leaf spring applies is not sufficient to restrain the load that the thermal expansion can create. Thus the parts slide relative to one another as required. The end result is that accessories mounted to rapid fire rifles in accordance with the new improvements of the invention are so well stabilized that they are "combat effectively" supported.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein.

DESCRIPTION OF THE PREFERRED EMBODIMENTS

Figure 1:
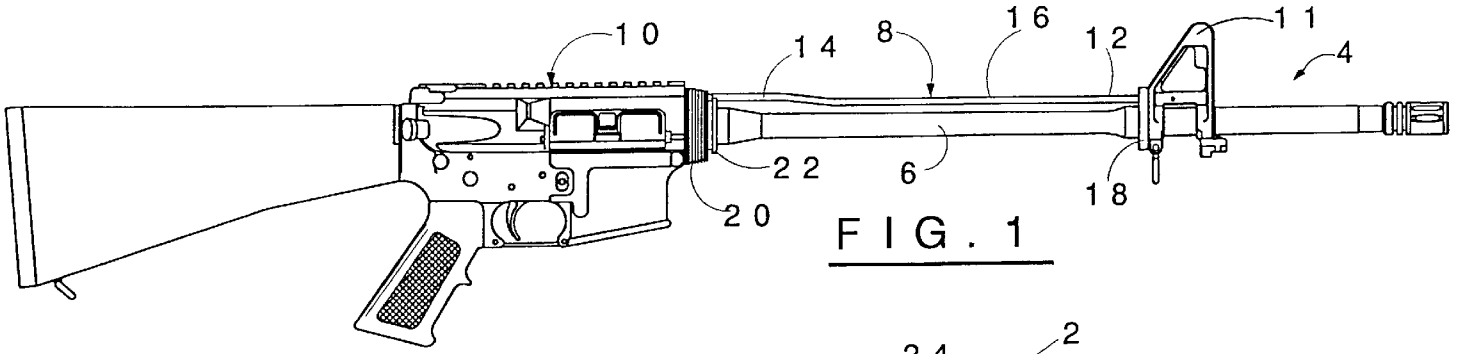
FIG. 1 is lateral view of a typical rapid fire rifle weapon for which the invention provides improved handguard systems that comprise rail adapters to accept and support accessory devices.
Figure 2:
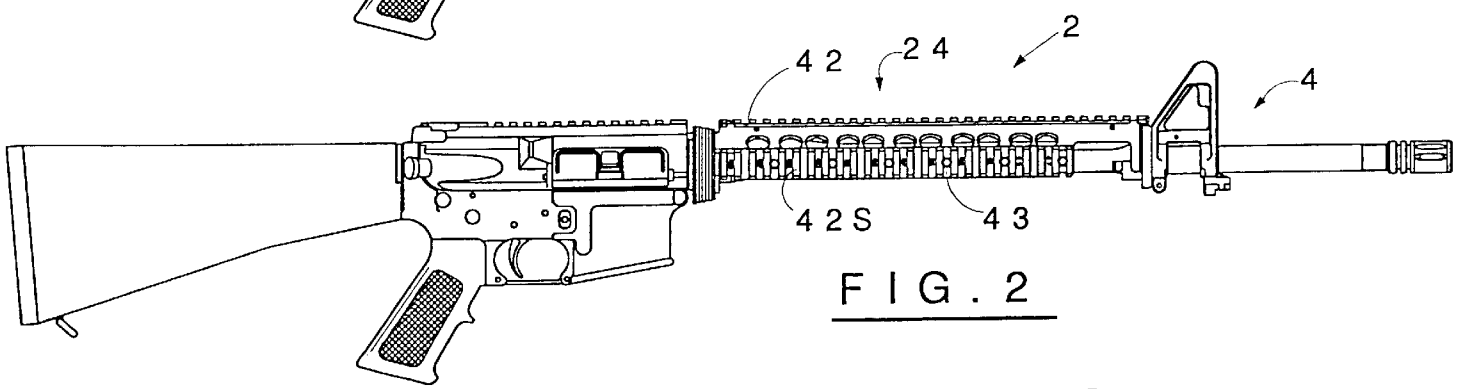
FIG. 2 is a lateral view of the weapon of FIG. 1 with the top semicylinderical part of the handguard system of the invention installed on the weapon.
Figure 3:
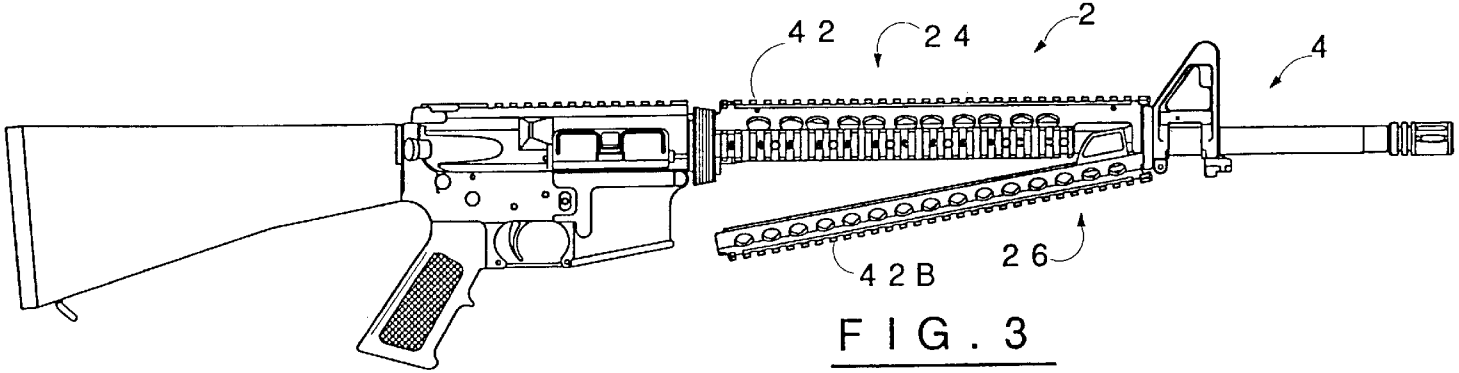
FIG. 3 is a lateral view of the weapon of FIG. 1 with the top semicylinderical part of the handguard system of the invention installed on the weapon and the bottom semicylinderical part being installed.

With reference to FIG. 1 of the drawings, the present invention provides an improved rail adapter system for a otherwise conventional rapid fire rifle 4 which typically includes a barrel 6 having a gas tube 8 plus firing mechanism 10 and other usual parts, e.g., front sight 11.

In the rapid fire rifles 4 to which the invention applies, the gas tube 8 is defined by a front end section 12 and a rear end section 14 integrally joined by a central section 16 extending longitudinally above the barrel 6.

A circular receptor cap 18 is fixed to the barrel 4 to encircle the front end section 12 of the gas tube 8.

A spring biased slip ring 20 is positioned about the barrel 6 rearward of the receptor cap 18 and a scalloped barrel nut 22 is carried on the barrel 6 juxtaposed to the slip ring 20 on the side facing the receptor cap 18.

With particular reference to FIGS. 2–5, the new handguard attachment 2 includes a top semicylinderical part 24 and a bottom semicylinderical part 26. The top part 24 is defined by a back end 27 having back end ledge 28 that engages with the slip ring 20 and a front end 30 having front end ledge 32 that engages with the receptor cap 18 to retain the part 24 about the barrel 6. Similarly, the bottom part 26 is defined by a back end 34 having back end ledge 36 that engages with the slip ring 20 and a front end 38 having front end ledge 40 that engages with the receptor cap 18 to retain the part 26 about the barrel 6.

An accessory adapter rail 42 extends longitudinally and upwardly from the top semicylinderical part 24. The handguard attachment 2 may also include accessory adapter side rails 42S and accessory adapter bottom rails 42B. The adapter rails are preferably integral, but could can be affixed by rivets, etc.

A support member 44 is fixed to the front end 30 of the part 24 for positioning the part 24 upon the barrel 6. Such support member 44 (see FIGS. 18–22) is defined by a fore end 46, an aft end 48 and comprises right longitudinal web 50, left longitudinal web 52 and rear spanner 54.

The spanner 54 fixes the longitudinal webs 50 & 52 spaced apart forming a longitudinal channel 56 therebetween.

A right lug 62 depends at the support member fore end 46 from the right longitudinal web 50 and a left lug 64 similarly depends from the left longitudinal web 52. The right and left lugs 62 & 64 have contact points 66 & 68 respectively to engage the barrel 6 in the positioning of the top part 24 on the rifle 4.

Figure 4:
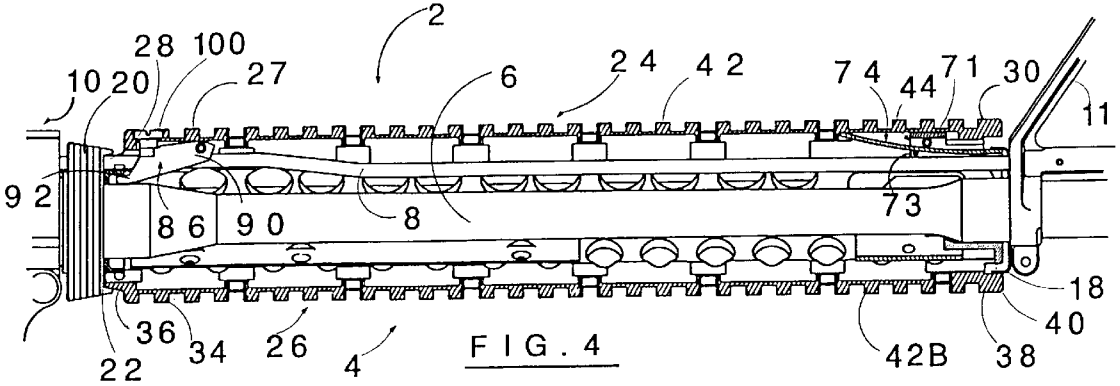
FIG. 4 is an enlarged lateral sectional view of top and the bottom semicylinderical parts of the handguard system of the invention installed on a rifle type weapon.
Figure 4A:
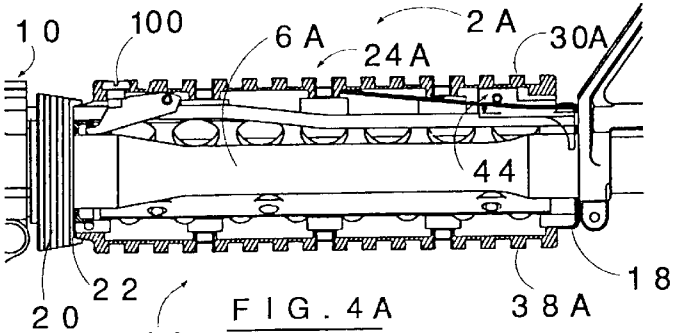
FIG. 4A is an enlarged lateral sectional view of top and the bottom semicylinderical parts of the handguard system of the invention installed on a carbine type weapon.
Figure 4B:
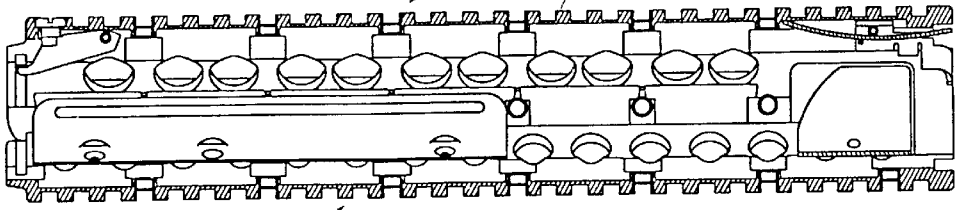
FIG. 4B is a sectional view corresponding to FIG. 4, but with the conventional parts of the weapon removed.
Figures 5, 6, 7, 8, 9, 10, 11:
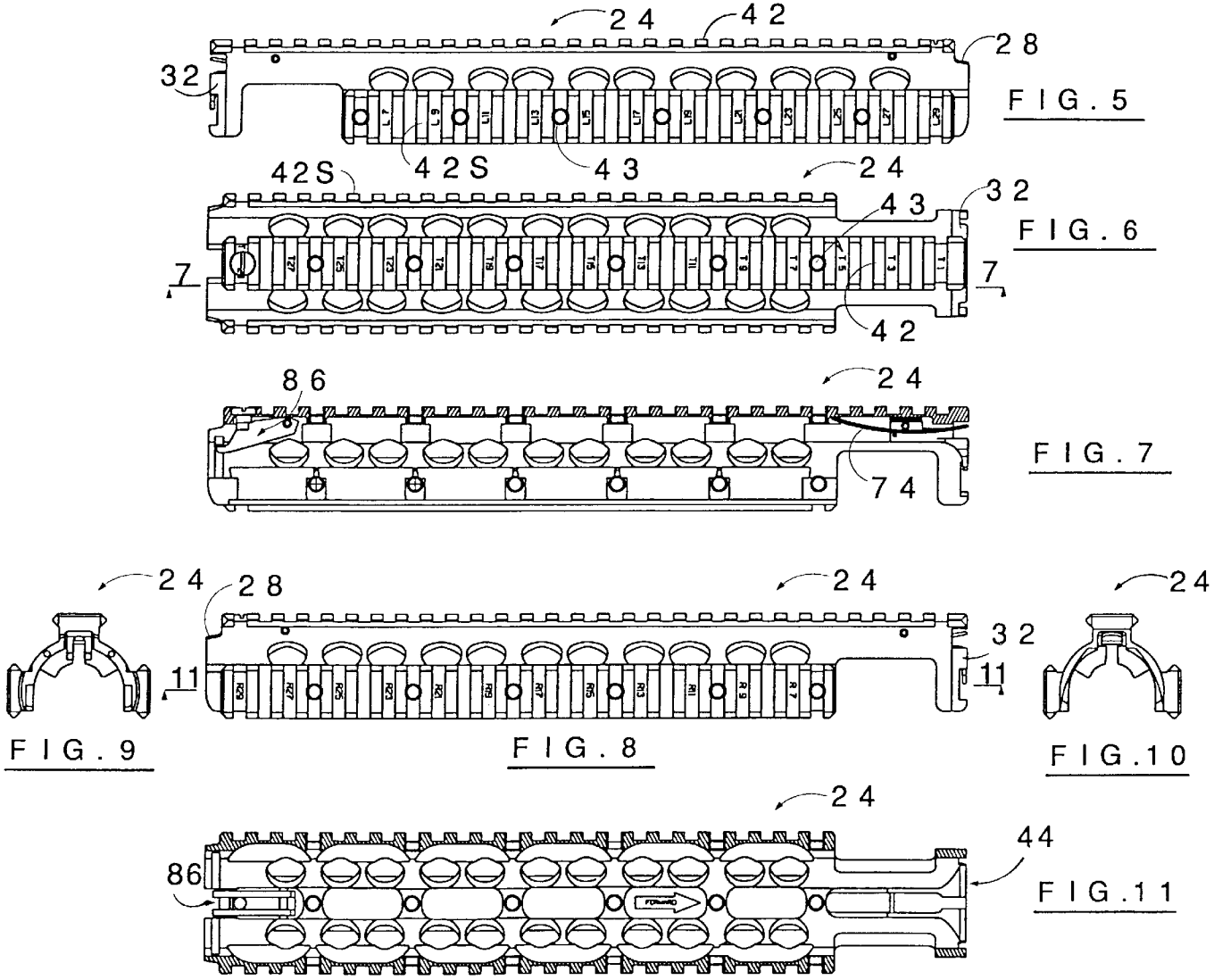
FIG. 5 is a left side view of the top semicylinderical part of the new handguard system.
FIG. 6 is a plan view of the top semicylinderical part of the new handguard system.
FIG. 7 is a sectional view taken on the line 7—7 of FIG. 6.
FIG. 8 is a right side view of the top semicylinderical part of the new handguard system.
FIG. 9 is a rear end view of the top semicylinderical part of the new handguard system.
FIG. 10 is a front end view of the top semicylinderical part of the new handguard system.
FIG. 11 is a sectional view taken on the line 11—11 of FIG. 8.

The support member 44 further has bores 70 to receive a pin 71 that fixes member 44 in the top part 24 and a transverse abutment 72. A cross pin 73 (as shown in FIG. 4A) held in bores (not shown) may be substituted for the integral abutment 72 as shown in FIGS. 19 & 21.

Figures 18, 19, 20, 21, 22, 23, 24, 25, 26, 27, 28, 29:
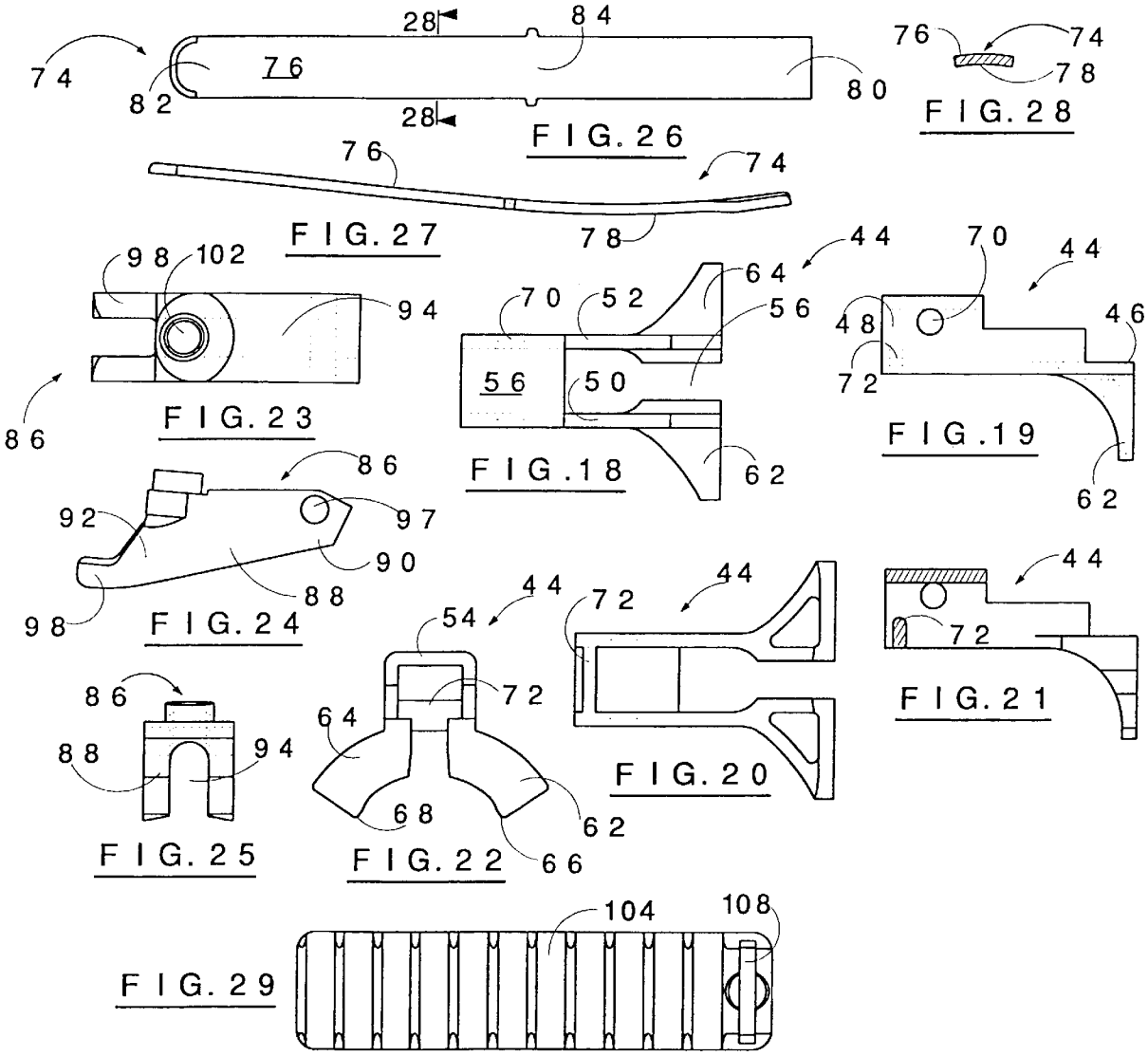
FIG. 18 is a plan view of the front support member for the top semicylinderical part of the new handguard system.
FIG. 19 is a right side view of the front support member.
FIG. 20 is a bottom view of the front support member.
FIG. 21 is a right side sectional view of the front support member.
FIG. 22 is a front end view of the front support member.
FIG. 23 is a plan view of the clamp member for the top semicylinderical part of the new handguard system.
FIG. 24 is a right side view of the clamp member.
FIG. 25 is a rear end view of the clamp member.
FIG. 26 is a plan view of the leaf spring for the top semicylinderical part of the new handguard system.
FIG. 27 is a right side view of the leaf spring.
FIG. 28 is a sectional view taken on the line 28—28 of FIG. 26.
FIG. 29 is plan view of one of a series of various length hand plates that can be attached to the semicylinderical parts of the new handguard system.

As shown in FIGS. 26–28, an elongated leaf spring 74 is defined by a top side 76, a bottom side 78, a fore end 80, an aft end 82 and an integral central portion 84. The fore end 80 is slidingly held by the receptor cap 18, the central portion 84 is slidingly carried in the longitudinal channel 56 of support member 44, the bottom side 78 of the central portion 84 slidingly engages lateral pin 73 fixed in the channel 56 between the right and left longitudinal webs 50 & 52. The aft end 82 bears against the underside of the top part 24. Alternatively, in the embodiment in which the abutment 72 is used in place of the lateral pin 73, the central portion 84 slidingly engages the abutment 72. In either case, the lateral pin 73 or the abutment 72 biases the top semicylinderical part 24 toward the barrel 6. At the same time, the lateral pin 73 or the abutment 72 biases the fore end 46 of the support member 44 initially toward the top semicylinderical part 24 whereupon the top semicylinderical part 24 pushes fore end 46 of the support member 44 into contact with the rifle barrel 6.

As shown in FIGS. 25–27, the rear clamp 86 that comprises a body 88 has a stem end 90 and stern end 92 and contains a channel 94 that straddles the rear end section 14 of the gas tube 8. The stem end 90 is pivoted for movement of the rear clamp 86 in a vertical plane upon pin 96 carried laterally within the top semicylinderical part 24 and through bores 97 in the body 88. A pair of spaced apart lugs 98 extend aft from the stern end 92 for engagement with the barrel nut 22. A screw fastener 100 extends through the adapter rail 42 and threads into a bore 102 in the body 88 whereby tightening of the screw fastener 100 serves to tighten engagement of the lugs 98 with the barrel nut 22.

Figures 3A, 12, 13, 14, 15, 16, 17:
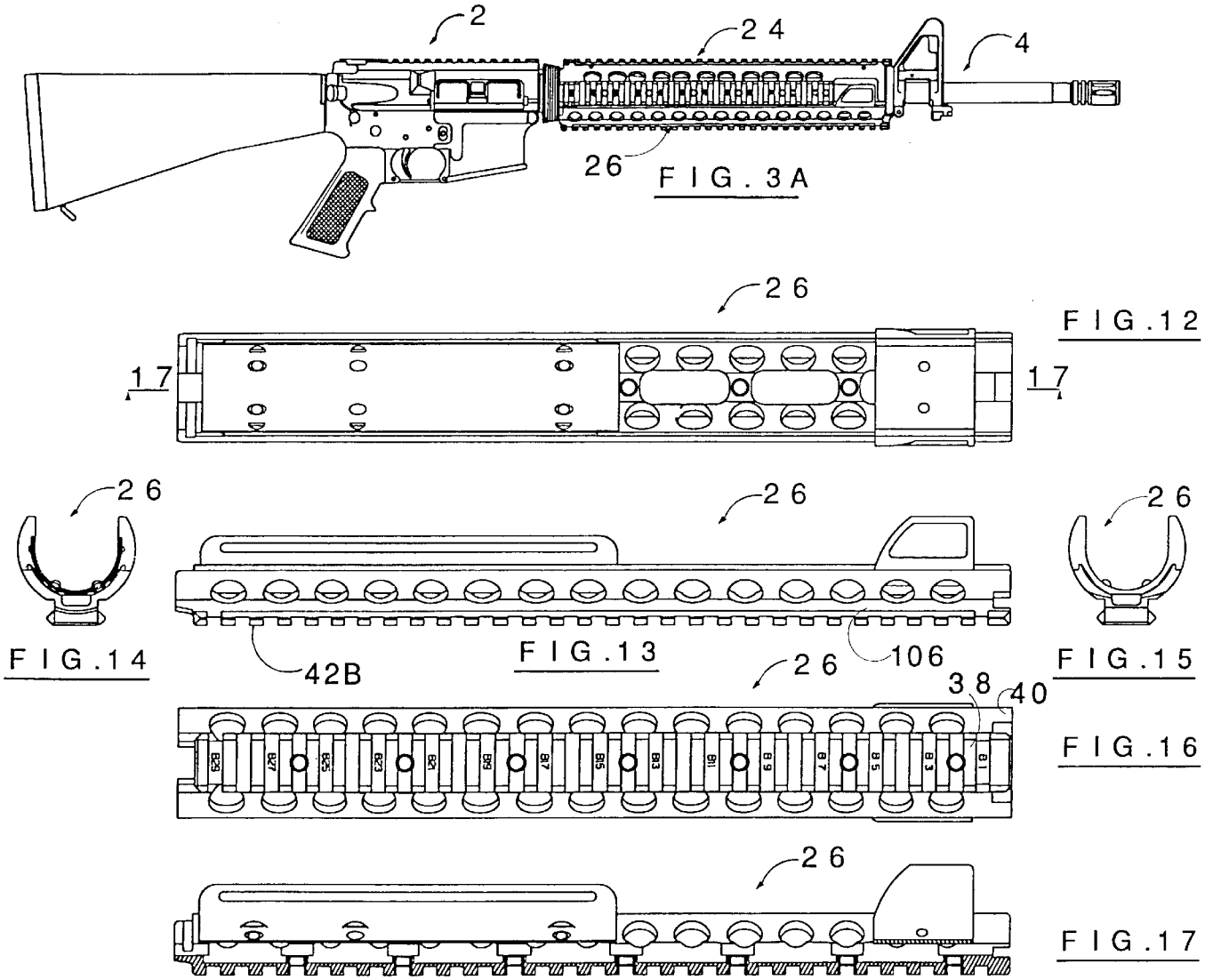
FIG. 3A is a lateral view of the weapon of FIG. 1 with the top and the bottom semicylinderical parts of the handguard system of the invention installed on the weapon.
FIG. 12 is a plan view of the bottom semicylinderical part of the new handguard system.
FIG. 13 is a right side view of the bottom semicylinderical part of the new handguard system.
FIG. 14 is a rear end view of the bottom semicylinderical part of the new handguard system.
FIG. 15 is a front end view of the bottom semicylinderical part of the new handguard system.
FIG. 16 is a bottom view of the bottom semicylinderical part of the new handguard system.
FIG. 17 is a sectional view taken on the line 17—17 of FIG. 12.

FIG. 29 shows one size of hand panels 104 that may be slid into place along a grooves in the top part 24 and bottom part 26, e.g., groove 106 (see FIG. 13) in the bottom part 26, to cover portions of the any of the adapter rails 42, 42S, & 42B. Leaf springs 108 snap into slots 110 in the adapter rails to hold the hand panels in position.

FIG. 4A shows the shortened form of the new handguard attachment 2A which is provided by the invention for use with a carbine 4A type of firearm. In FIG. 4A, the letter"A" is used to indicate those parts of the attachment 2A that are modified to accommodate the shortened length of the carbine 4A, but otherwise correspond to their non-"A" numbered counterparts shown and described relative to the rifle 4 type firearm.

I claim:

1. In a handguard attachment for a firearm including a barrel and having a gas tube defined by a front end section and a rear end section integrally joined by a central section extending longitudinally above said barrel, a circular receptor cap fixed to said barrel to encircle said barrel and said front end section of said gas tube, a spring biased slip ring positioned about said barrel rearward of said receptor cap, and a barrel nut carried on said barrel juxtaposed to said slip ring on the side of said slip ring facing said receptor cap, said handguard attachment including a top semicylinderical part defined by a first front end portion and a first back end portion and a bottom semicylinderical part defined by a second front end portion and a second back end portion, said first and second back end portions having back end ledges that engage with said slip ring and said first and second front end portions having front end ledges that engage with said receptor cap to retain said parts about said barrel, an improved rail adapter system which enables said firearm effectively to support accessory devices which comprises:

an accessory adapter rail extending longitudinally along said top semicylinderical part, an elongated leaf spring defined by a top side, a bottom side, a fore end, an aft end and an integral central portion, said fore end being slidingly held by said receptor cap, said aft end slidingly positioned in said top semicylinderical part and said bottom side of said central portion slidingly engaging a lateral element fixed within said first front end portion below said adapter rail whereby to bias said top semicylinderical part toward said barrel, and a rear clamp comprising a channelled body that straddles said rear end section of said gas tube having a stem end and stern end, said stem end being pivoted for movement of said rear clamp in a vertical plane upon a pin carried laterally within said top semicylinderical part, a pair of spaced apart lugs that extend aft from said stern end for engagement with said barrel nut and a screw fastener that extends through said adapter rail and threads into said channelled body whereby tightening of said screw fastener serves to tighten engagement of said lugs with said barrel nut.

2. In a handguard attachment for including a barrel and a firearm having a gas tube defined by a front end section and a rear end section integrally joined by a central section extending longitudinally above said barrel, a circular receptor cap fixed to said barrel to encircle said front end section of said gas tube, a spring biased slip ring positioned about said barrel rearward of said receptor cap, and a barrel nut carried on said barrel juxtaposed to said slip ring on the side of said slip ring facing said receptor cap, said handguard attachment including a top semicylinderical part defined by a first front end portion and a first back end portion and a bottom semicylinderical part defined by a second front end portion and a second back end portion, said first and second back end portions having back end ledges that engage with said slip ring and said first and second front end portions having front end ledges that engage with said receptor cap to retain said parts about said barrel, an improved rail adapter system which enables said firearm effectively to support accessory devices which comprises:

an accessory adapter rail extending longitudinally along said top semicylinderical part, a support member fixed to said front end of said top semicylinderical part for positioning said top semicylinderical part upon said barrel, said support member being defined by a fore end and an aft end and which comprises a pair of right and left longitudinal webs, a lateral web that fixes said longitudinal webs spaced apart forming a longitudinal channel therebetween, a right lug dependent at said support member fore end from said right longitudinal web and a left lug dependent at said support member fore end from said left longitudinal web, said right and left lugs having contact points to engage said barrel in said positioning, an elongated leaf spring defined by a top side, a bottom side, a fore end, an aft end and an integral central portion, said fore end being slidingly held by said receptor cap, said aft end slidingly carried in said longitudinal channel and said bottom side of said central portion slidingly engaging a lateral element fixed in said channel between said right and left longitudinal webs whereby said lateral pin biases said top semicylinderical part toward said barrel, and a rear clamp comprising a channelled body that straddles said rear end section of said gas tube having a stem end and stern end, said stem end being pivoted for movement of said rear clamp in a vertical plane upon a pin carried laterally within said top semicylinderical part, a pair of spaced apart lugs that extend aft from said stern end for engagement with said barrel nut and a screw fastener that extends through said adapter rail and threads into said channelled body whereby tightening of said screw fastener serves to tighten engagement of said lugs with said barrel nut.

3. The handguard attachment of claim 2 that comprises a plurality of accessory adapter rails extending longitudinally along said top semicylinderical part.

4. The handguard attachment of claim 2 that comprises an accessory adapter rail extending longitudinally along said bottom semicylinderical part.

5. The handguard attachment of claim 2 that comprises a plurality of accessory adapter rails extending longitudinally along said top semicylinderical part.

6. The handguard attachment of claim 2 that comprises an accessory adapter rail extending longitudinally along said bottom semicylinderical part.

7. The handguard attachment of claim 2 wherein said lateral element that engages said central portion of said leaf spring is a pin fixed between said longitudinal webs of said support member.

8. The handguard attachment of claim 7 wherein said lateral element is a pin fixed between said longitudinal webs of said support member and said pin engages said bottom side of said central portion of said leaf spring and initially biases said fore end of said support member toward said top semicylinderical part.

9. The handguard attachment of claim 2 wherein said lateral element that engages said central portion of said leaf spring is a transverse abutment fixed between said longitudinal webs of said support member.

10. The handguard attachment of claim 9 wherein said lateral element is a transverse abutment fixed between said longitudinal webs of said support member and said pin engages said bottom side of said central portion of said leaf spring and initially biases said fore end of said support member toward said top semicylinderical part.

* * * * *